US005188199A

United States Patent [19]

Shirai

[11] Patent Number: 5,188,199

[45] Date of Patent: Feb. 23, 1993

[54] WAREHOUSING TRAVELING CRANE

[75] Inventor: Yoji Shirai, Suita, Japan

[73] Assignee: Daifuku Co., Ltd., Osaka, Japan

[21] Appl. No.: 791,975

[22] Filed: Nov. 13, 1991

[30] Foreign Application Priority Data

May 13, 1991 [JP] Japan ..... 3-138241

[51] Int. Cl.[5] ..... B66B 7/02

[52] U.S. Cl. ..... 187/95; 187/9 R

[58] Field of Search ..... 187/95, 8.41, 8.59, 187/9 R, 9 E, 20

[56] References Cited

U.S. PATENT DOCUMENTS 1,714,297 5/1929 Crispen ..... 187/95
3,887,092 6/1975 Leet ..... 187/95
4,763,761 8/1988 McKinsey et al. ..... 187/8.41

FOREIGN PATENT DOCUMENTS 1285396 12/1968 Fed. Rep. of Germany ..... 187/95

*Primary Examiner*—D. Glenn Dayoan
*Assistant Examiner*—Kenneth Noland
*Attorney, Agent, or Firm*—Schweitzer Cornman & Gross

[57] ABSTRACT

A traveling crane, comprising an upper frame, a lower frame, an elongated guide post between the upper and lower frames, an elevating platform adapted to move up and down along the guide post, a device for moving the elevating platform, and a load transfer device mounted on the elevating platform, the guide post being a hollow aluminum extrusion being formed with an integral grove throughout its length, a guide roller attached to the edge of the elevating platform for rolling within the groove as the elevating platform moves up and down along the guide post, the device for moving including a drive chain attached to the elevating platform for suspending, raising, lowering the platform, a motor and a device for transferring the rotation of the motor to move the chain, the chain being threaded through the interior of the hollow guide post.

2 Claims, 5 Drawing Sheets

WAREHOUSING TRAVELING CRANE

FIELD OF THE INVENTION

The present invention relates to a traveling crane that is particularly useful in automated warehousing operations, and more particularly to a traveling crane having an elevating platform which moves up and down along a guide post for linking a lower frame and an upper frame, and a load transfer device mounted on the elevating platform.

BACKGROUND OF THE INVENTION

In conventional traveling cranes of this type, a round or square steel pipe is used as the guide post, a continuous lengthy guide rail is attached to the outer surface of the steel pipe, and the elevating platform is guided by this guide rail. Such conventional construction is not only costly due to the high cost of the entire guide post including the guide rail, but also the crane is very heavy.

BRIEF DESCRIPTION OF THE INVENTION

The present invention relates to a traveling crane having a hollow, extruded aluminum guide post formed integrally with a groove extending along the entire length and disposed in the center of the opposite sides of the post. An elevating platform is provided on its side with a guide roller which is fitted in the groove. A drive chain for lifting the elevating platform is led through the interior of the guide post to the side of the guide post at its lower end and the chain is engaged by a pinion gear of a driving means disposed near the lower end of the guide post.

In this construction of the crane of the invention, by making the guide post from an aluminum extrusion, the groove for fitting the guide roller on the side of the elevating platform is formed integrally with the post, compared to the conventional method of preparing the guide post by welding or affixing the guide rail to the outside of the steel pipe. Thus the cost of the entire crane, its weight, and its size can be substantially reduced by the improved structure of the present invention.

Furthermore, since the grooves are formed on the opposite sides of the guide post, when using a pair of front and rear guide posts, it is sufficient to use only a single groove, or when only one side of the elevating platform is supported by using only one guide post, the guide post can be disposed so that the groove can be positioned on both the right and left sides and the elevating platform can be stably supported by the guide roller fitting into both grooves.

According to a particularly suitable embodiment of the invention, the rolling surface of the grooves contacted by the guide rollers is covered with a hard, noncorroding, suitably anodically prepared oxide film for enhancing the durability of the guide post.

DESCRIPTION OF THE DRAWING

Other features of the invention are described in detail in connection with suitable embodiments of the invention with reference being had to the accompanying drawing, wherein.

DETAILED DESCRIPTION

Figure 1:
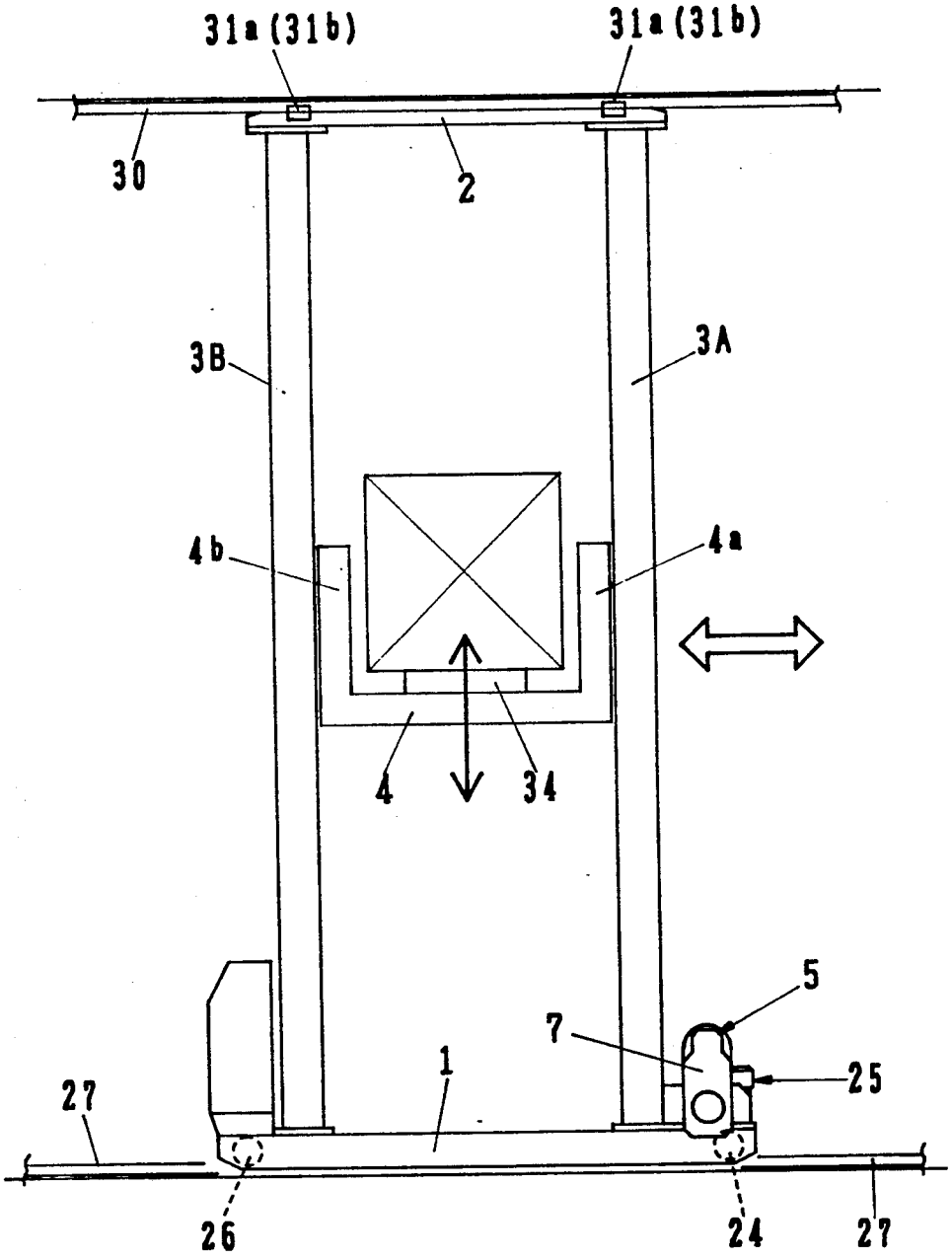
FIG. 1 is a side view of a traveling crane of the invention.
Figure 2:
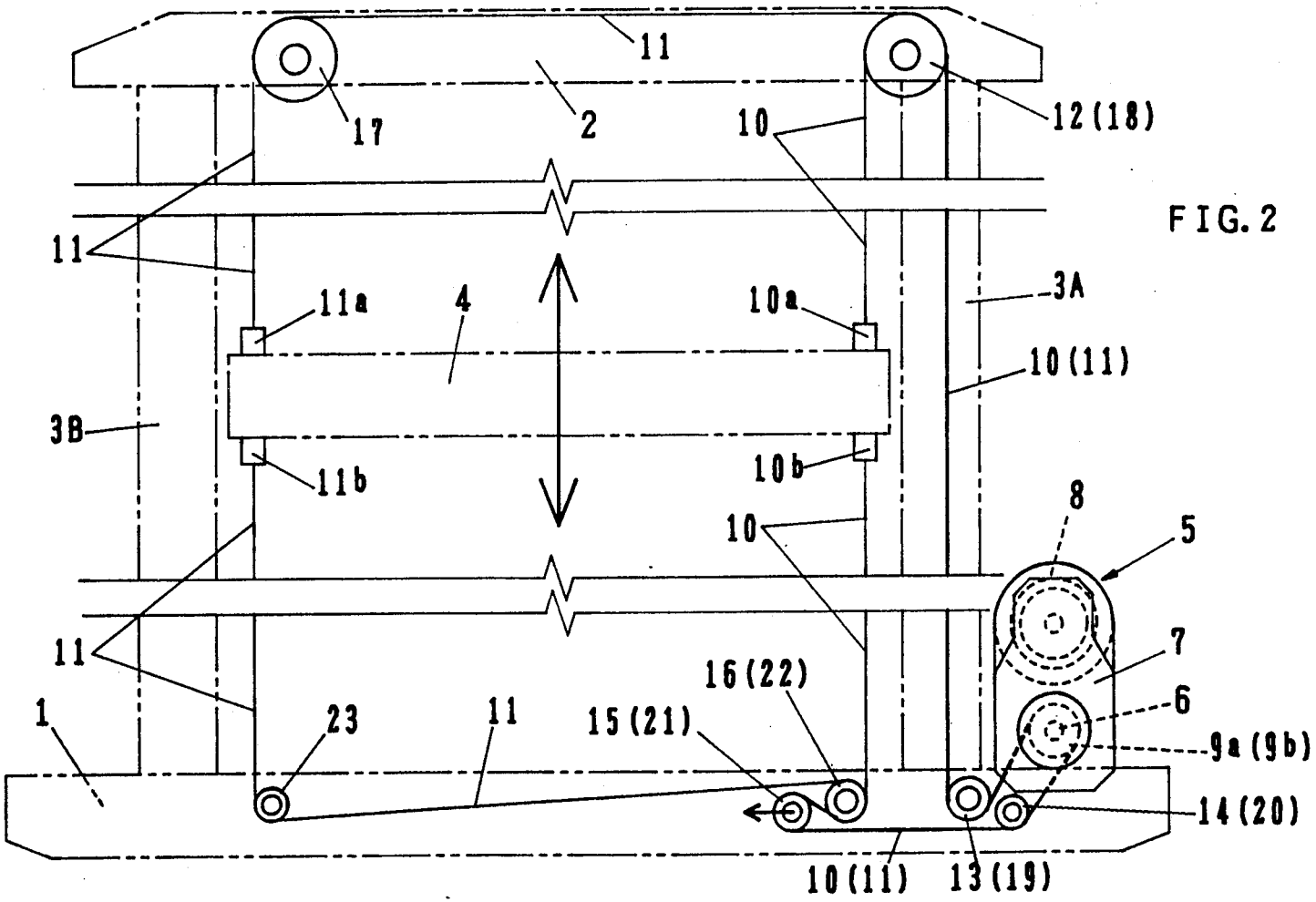
FIG. 2 is a schematic side view of the crane, particularly showing the means for elevating and driving the elevating platform.

In FIGS. 1–4 a lower frame 1, an upper frame 2, are connected to each other by front and rear guide posts 3A and 3B. An elevating platform 4 ascends and descends between the guide posts 3A, 3B. A drive 5 of the elevating platform 4 has a drive shaft 6 supported horizontally on the upper side of one end of the lower frame 1, and a motor 8 is provided for driving the shaft 6 forward and backward through a reduction gear 7. The drive 5 has two drive chains 10, 11 for elevating and driving the platform 4 through engagement with two pinion gears **9*a*, 9*b* mounted on the drive shaft 6**.

One drive chain 10 has one of its ends **10*a* attached to the top of the elevating platform 4 adjacent to the guide post 3A. The chain rotates freely over an idler 12 which is mounted from the upper frame 2. From here the chain 10 passes to the lower frame 1 through the interior of the guide post 3A, and then rotates freely over an idler 13 which is mounted from the lower frame 1. Then the chain 10 passes over the pinion gear 9*a* and an idler 14 in the lower frame 1, then through tensioning idlers 15 and 16 the chain passes upwardly from inside the lower frame 1, and its other end 10*b* is attached to the lower side of the elevating platform 4 adjacent to the guide post 3A**.

The other drive chain 11 has one end **11*a* attached to the top of the elevating carriage 4 at a position adjacent to the guide post 3B. The chain 11 then passes over an idler 17 mounted from the upper frame 2. Then the chain 11 passes in succession through an idler 18 that coaxial with the idler 12, through the interior of the upper frame 2, and is led into the lower frame 1 though the interior of the guide post 3A, and then about the pinion gear 9*b*, idler 19 that is coaxial with the idler 13. Then the chain 11 passes through an idler 20 that is coaxial with the idler 14 in the lower frame 1, then through tensioning idlers 21 and 22 that are respectively coaxial with tensioning idlers 15 and 16, then passed the idler 23, from where it is led upward and its other end 11*b* is attached to the underside of the elevating platform 4 adjacent to the guide post 3B**.

Therefore, when the drive pinions **9*a*, 9*b* in the drive 5 are driven forward (clockwise in FIG. 2) by the motor 8, the chains 10, 11 suspending the elevating platform 4 raise the elevating carriage 4 along the guide posts 3A, 3B. The portions of the both chains 10, 11 passing from the pinion gears 9*a*, 9*b* are pulled by the elevating platform 4 which moves upward. When the pinion gears 9*a***, 9*b* are driven in reverse (counterclockwise) the elevating platform 4 is lowered.

Figure 3:
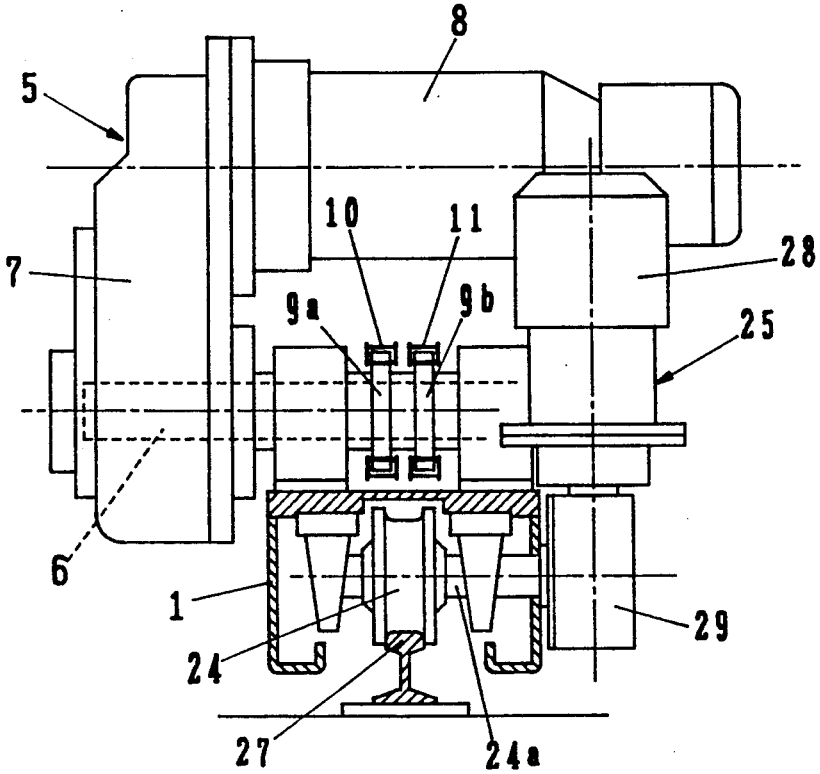
FIG. 3 is a partial longitudinal cross-sectional front view showing the essential parts of the elevating and driving means and the traveling drive of the crane.

As shown in FIGS. 1 and 3 a traveling drive is disposed in the lower frame 1. The traveling drive 25 has a grooved drive wheel 24 attached by a driven shaft 24*a* to one end of the lower frame 1 and a groove free roller 26 is attached to its other end. A supporting guide rail 27 rests on the floor and the wheels 24, 26 are adapted to run over that rail. As shown in FIG. 3, the traveling drive 25 comprises a vertically disposed motor 28 and an orthogonal transmission 29 for transmitting the rotation of the motor 28 to the drive shaft 24*a* of the driven wheel 24.

Figure 4:
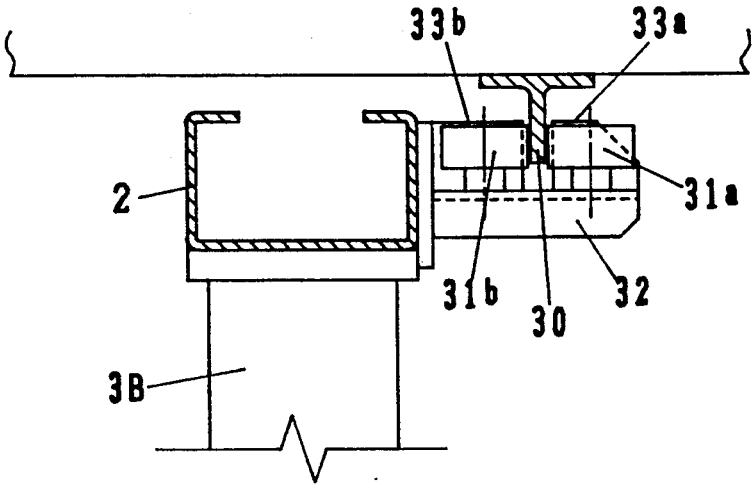
FIG. 4 is a partial longitudinal cross-sectional rear view showing the anti-vibration guide rail in the upper frame of the crane.

As shown in FIG. 4, in the sides near the front and the rear ends of the upper frame 2, front and back pairs of right and left top guide post rollers 31*a*, 31*b* are mounted from a bracket 32 and disposed respectively on the right and left sides of the anti-vibration guide rail 30 that is attached to the ceiling side. Each bracket 32 is provided with retaining plates 33*a*, 33*b* that are respectively disposed on both sides of the rail 30 for preventing the crane from toppling if the rollers 31*a*, 31*b* drop out from their position on the right and left sides of the anti-vibration guide rail 30.

When the motor 28 of the traveling drive 25 rotates the driven wheel 24, the crane will travel forward or backward along the guide rails 27, 30 which support it.

Figure 5:
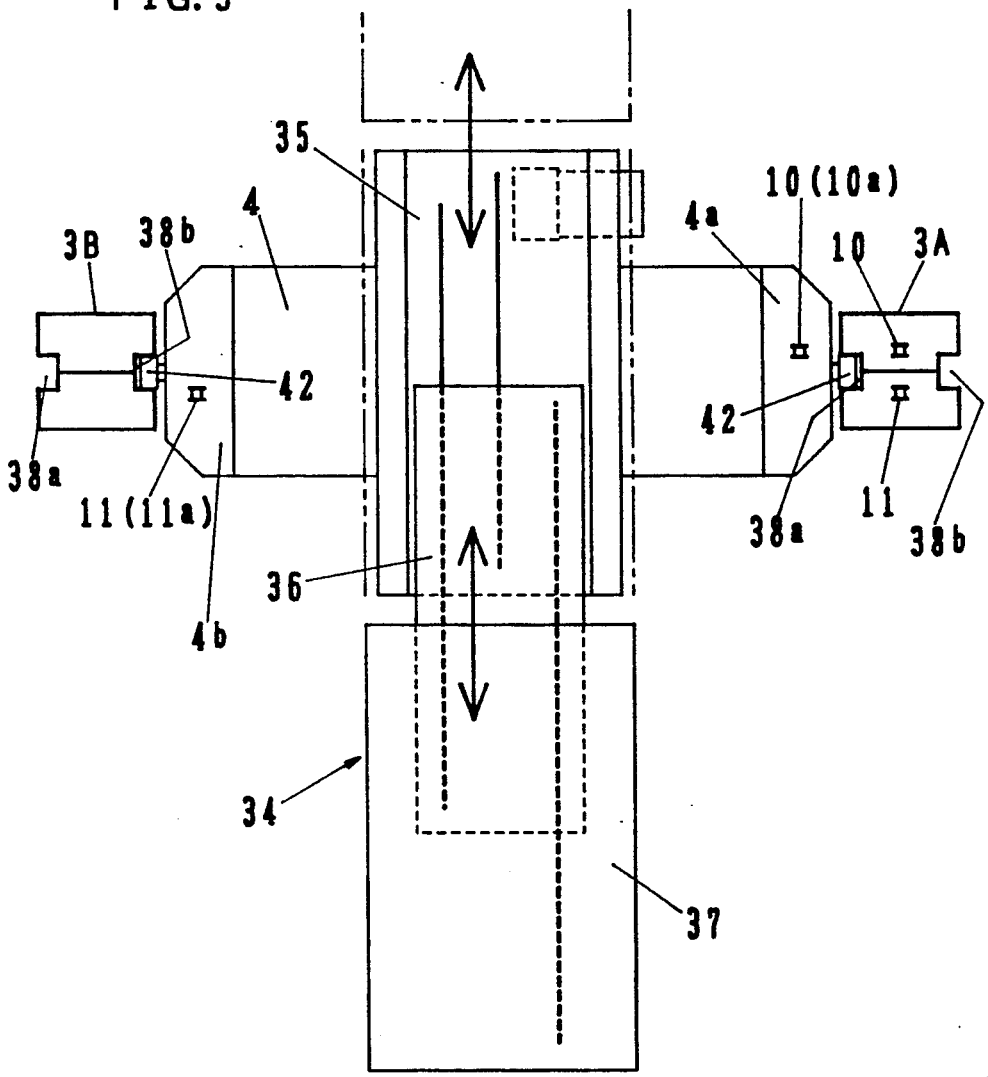
FIG. 5 is a cross sectional plan view showing the front and rear guide posts of the elevating platform.
Figure 6:
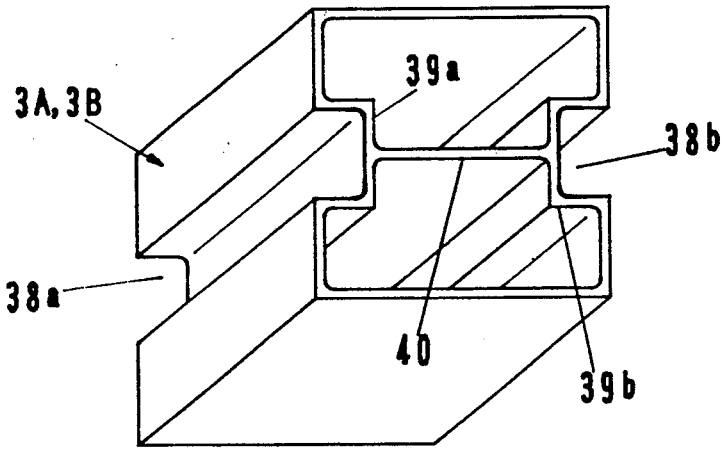
FIG. 6 is a perspective view showing a portion of the guide post.
Figure 7:
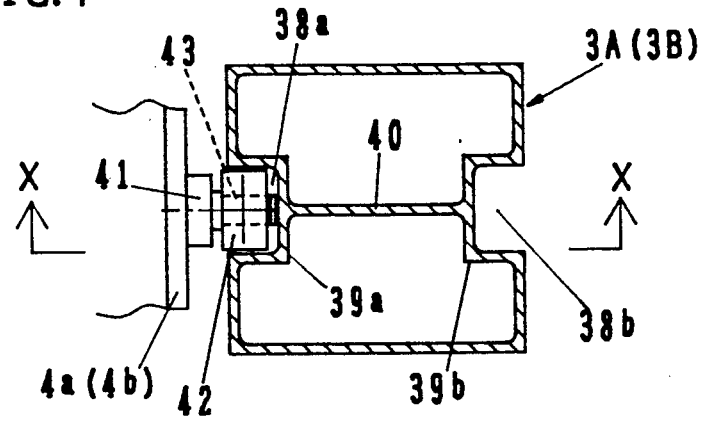
FIG. 7 is a cross sectional plan view showing the engaging of a guide post by a roller on the elevating platform.
Figure 8:
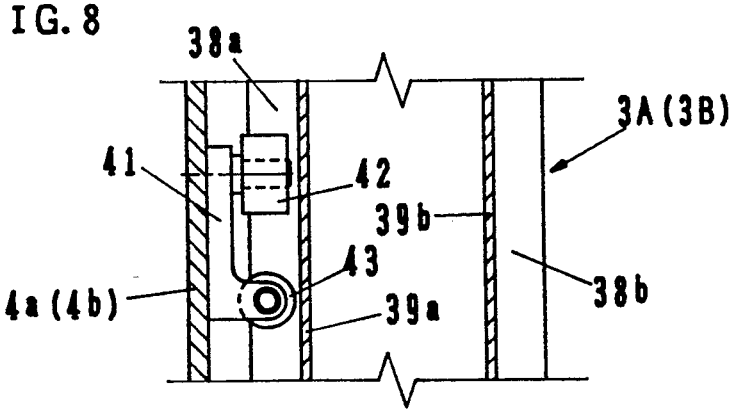
FIG. 8 is a cross-sectional view taken along the line 8—8 in FIG. 7.

As shown in FIG. 5, a load transfer device 34 is installed on the elevating platform 4. This load transfer device 34 is of a per se conventional running fork type structure that has a fixed fork 35 attached to the elevating platform 4, a secondary fork 36 supported free to move in or out in any right or left direction on the fixed fork 35, and a primary fork 37 supported free to move in or out in any right or left direction on the secondary fork 36. A running fork-type load transfer device is described in patent application Ser. No. 791,972 filed on even date herewith.

The guide posts 3A, 3B are each of a square cross-section hollow aluminum extrusion having integrally formed square cross-section grooves 38*a*, 38*b* extending continuously along their entire lengths. The grooves are located at the center of two opposite sides as shown in FIGS. 5 to 8. An interior reinforcing plate 40 extends along the entire length of each post by linking the walls 39*a*, 39*b* forming the grooves 38*a*, 38*b*. The guide posts 3A, 3B are arranged on each side along the elevating platform 4 in one of the grooves 38*a*, 38*b*. A pair of upper lateral guide rollers 42 and an axial guide roller 43 are mounted from bracket 41 that is attached to an end of the elevating platform 4 are disposed within a groove 38. Another pair of such lateral and an axial guide rollers are mounted from the other end of the elevating platform (not shown). As shown in FIG. 5 (on the right side only), the carriage elevating and driving chains 10, 11 pass within the guide posts 3A, 3B on both sides of the reinforcing plate 40.

In this construction of the guide posts 3A, 3B as mentioned above, when the elevating platform 4 is moved up or down, the lateral guide roller 42 and the axial guide roller 43 roll and move up and down in the groove 38*a* of the guide post 3A and the groove 38*b* of the guide post 3B, thereby maintaining the constant, stable position of the elevating platform 4. Each pair of the lateral guide rollers 42 on each side of the elevating platform 4 rolls on both opposite sides of a respective grooves 38, and the axial guide roller 43 rolls on the bottom surface of a groove 38. The durability of the grooves can be improved by covering these roller rolling surfaces, that is, the entire inner surface of the grooves 38*a*, 38*b* with a hard, anodized, noncorroding oxide film.

I claim:

1. A traveling crane, comprising an upper frame, a lower frame, and elongated guide post between said upper and lower frames, an elevating platform adapted to move up and down along said guide post, means for moving said elevating platform, and a load transfer device mounted on said elevating platform, the guide post being a hollow aluminum extrusion being formed with at least two integral grooves throughout its length, on opposite sides of the guide post and reinforcing means disposed within said guide post between the interior walls of said grooves, a guide roller attached to the edge of said elevating platform for rolling within said groove as said elevating platform moves up and down along said guide post, said means for moving including a drive chain attached to said elevating platform for suspending, raising, and lowering said platform, a motor, and means for transferring the rotation of the motor to move said chain, the chain being threaded through the interior of said hollow guide post.

2. The traveling crane of claim 1, wherein the inner surface of said groove of the guide post is covered with an anodized hard, noncorroding oxide film.

* * * * *